US008081889B2

(12) United States Patent
Kim

(10) Patent No.: US 8,081,889 B2
(45) Date of Patent: Dec. 20, 2011

(54) IMAGE FORMING APPARATUS AND CONTROL METHOD THEREOF

(75) Inventor: Dae-Ho Kim, Uiwang-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 468 days.

(21) Appl. No.: 12/331,026

(22) Filed: Dec. 9, 2008

(65) Prior Publication Data

US 2009/0185830 A1 Jul. 23, 2009

(30) Foreign Application Priority Data

Jan. 21, 2008 (KR) ..... 10-2008-0006318

(51) Int. Cl.
*G03G 21/00* (2006.01)

(52) U.S. Cl. ..... 399/34; 399/36; 399/71; 399/222

(58) Field of Classification Search ..... 399/36, 399/167, 34, 71, 123, 100, 222
See application file for complete search history.

(56) References Cited

U.S. PATENT DOCUMENTS

| | | | | |
|---|---|---|---|---|
| 5,220,391 | A * | 6/1993 | Tange | 399/349 |
| 7,062,194 | B2 * | 6/2006 | Yanagida et al. | 399/100 |
| 7,139,502 | B2 * | 11/2006 | Koishi et al. | 399/93 |
| 2005/0232668 | A1 * | 10/2005 | Shida | 399/354 |

FOREIGN PATENT DOCUMENTS

KR 10-2007-0052132 5/2007

OTHER PUBLICATIONS

English language abstract of KR 10-2007-0052132, published May 21, 2007.

* cited by examiner

*Primary Examiner* — David Gray
*Assistant Examiner* — G. M. Hyder
(74) *Attorney, Agent, or Firm* — Stanzione & Kim, LLP

(57) ABSTRACT

An image forming apparatus includes: an image receptor; a developing member which develops a latent image on the image receptor with a toner; an anti-spattering member collecting free toner particles, a driver which drives the developing member and the anti-spattering member; and a controller which controls the driver not to drive the anti-spattering member during a printing operation, and to drive the anti-spattering member at other times when printing operation is not being performed.

21 Claims, 12 Drawing Sheets

IMAGE FORMING APPARATUS AND CONTROL METHOD THEREOF

CROSS-REFERENCE TO RELATED APPLICATION

This application claims priority from Korean Patent Application No. 10-2008-0006318, filed on Jan. 21, 2008, in the Korean Intellectual Property Office, the disclosure of which is incorporated herein by reference.

BACKGROUND OF THE INVENTION

1. Field of the Invention

Apparatuses and methods consistent with the present invention relate to an image forming apparatus and a control method thereof, and more particularly, to an image forming apparatus that is capable of reducing vibration and noise caused by an anti-spattering member during a printing operation, and a control method thereof.

2. Description of the Related Art

An image forming apparatus is an electronic device which forms an image on a print medium. Recently, an electrophotographic image forming apparatus as a laser printer has attracted much attention.

An electrophotographic image forming apparatus may include a photosensitive body, a light scanning unit to expose the photosensitive body and to form an electrostatic latent image, a developing roller to develop the electrostatic latent image with toner into a visible image, a transfer roller to transfer the visible image on the surface of the photosensitive body to a print medium, and a fusing roller to fuse the toner transferred to the print medium by, e.g., heat and pressure.

The image forming apparatus may further include an anti-spattering member to gather spattered toner and prevent the toner from being spattered since the toner is likely to be spattered while the developing roller develops an image and/or when the transfer roller transfers the image.

Korean Patent Application No. 10-2005-0109802, filed Nov. 16, 2005, which has been published as Korean Patent Application Publication No. 10-2007-0052132, entitled "A DEVELOPING DEVICE OF AN IMAGE FORMING APPARATUS," assigned to the present assignee, the entire disclosure of which is incorporated herein by reference, discloses a developing cartridge having an anti-spattering member.

A conventional image forming apparatus may gather the spattered toner as the anti-spattering member rotates, but may also create noise and/or vibration during the printing operation, which may in turn may cause a jitter that may result in deterioration of image quality.

SUMMARY OF THE DISCLOSURE

Accordingly, it is an aspect of the present invention to provide an image forming apparatus with reduced noise and vibration that may result from an anti-spattering member.

Additional aspects of the present invention will be set forth in part in the description which follows and, in part, will be obvious from the description, or may be learned by practice of the present invention.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION OF SEVERAL EMBODIMENT

Hereinafter, exemplary embodiments of the present invention will be described with reference to accompanying drawings, wherein like numerals refer to like elements.

Figure 1:
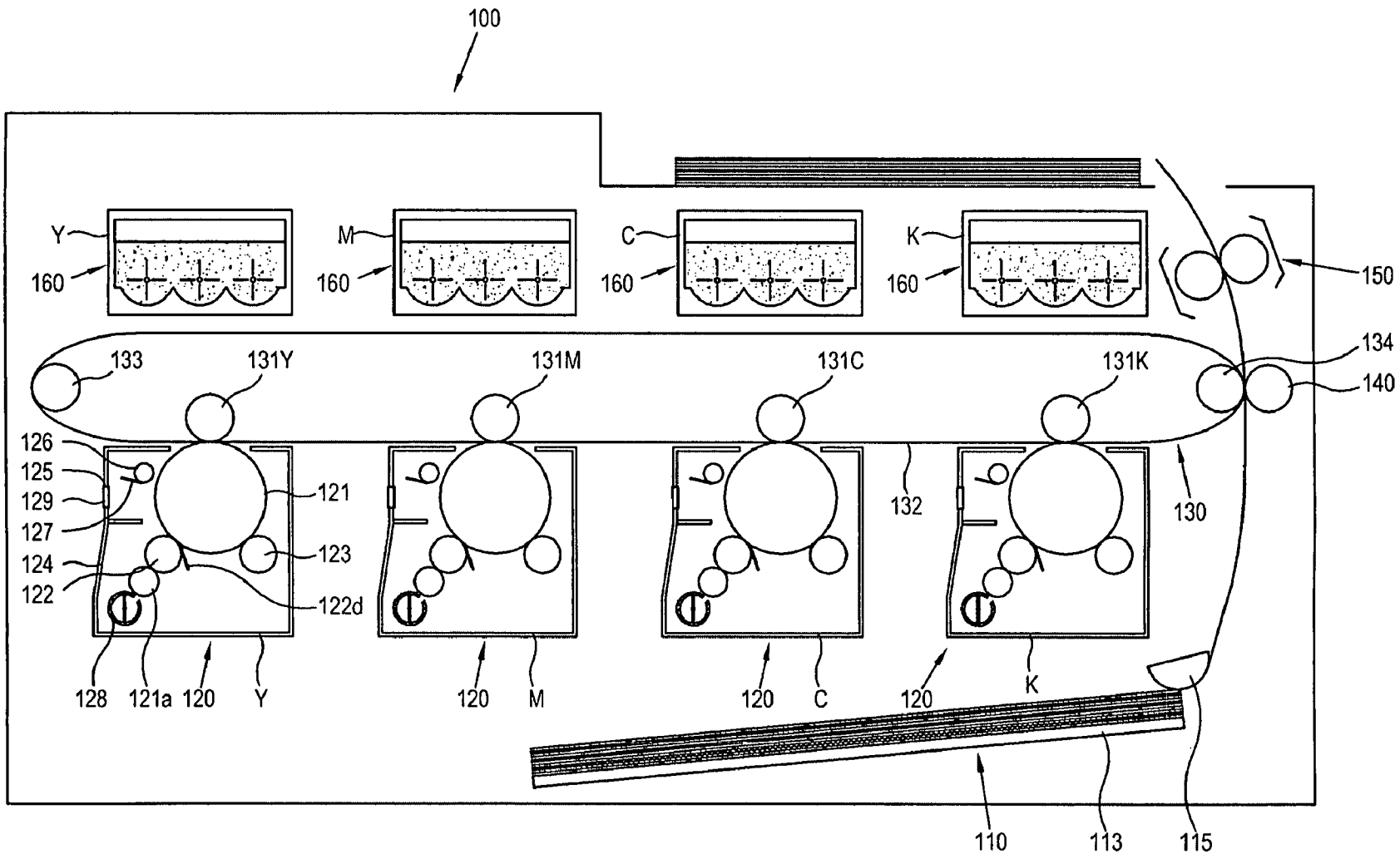
FIG. 1 is a sectional schematic view of an image forming apparatus according to an embodiment of the present invention.

As shown in FIG. 1, an image forming apparatus 100 according to the present invention may include a paper feeding unit 110, a plurality of developing cartridges 120, an intermediate transfer unit 130, a transfer unit 140 and a fusing unit 150.

While in the embodiment shown, a plurality of the developing cartridges 120 are provided to realize a color image, the scope of application of the present invention is not so limited, and a single developing cartridge 120 may alternatively be provided. If a single cartridge 120 is used, it may not be necessary for the image forming apparatus to include the intermediate transfer unit 130.

The paper feeding unit 110 includes a plate 113 to load a print medium thereon and a pickup roller 115 to pick up the print medium and to supply it to the intermediate transfer unit 130 and the transfer unit 140.

Each of the developing cartridges 120 may include an image receptor 121, a developing member 122, a charger 123 to charge the image receptor 121 with a predetermined surface electric potential and an anti-spattering member 126. Each of the image receptors 121 may include a photosensitive drum.

As shown in FIG. 1, the developing cartridges 120 each stores yellow (Y), magenta (M), cyan (C) and black (K) toners, respectively, from the left to the right.

The intermediate transfer unit 130 may include an intermediate transfer belt 132, a pair of rollers 133 and 134 to drive and to rotate the belt 132, and intermediate transfer rollers 131Y, 131M, 131C and 131K.

The image forming apparatus 100 may further include exposing units (not shown) corresponding to the number of the developing cartridges 120 and a high voltage power supply (HVPS) 190 (shown in FIG. 2) to supply a high voltage to the developing member 122.

A color printing operation of the image forming apparatus 100 having the foregoing elements will now briefly be described.

A color image is formed by overlapping toner images in yellow, magenta, cyan and black colors. First, a process of forming a yellow image will be described.

A surface of the image receptor 121 of the yellow developing cartridge 120Y is charged by the charger 123 to a predetermined voltage, e.g., approximately −1200V. The exposing unit exposes the surface of the image receptor 121 corresponding to an area which is to be developed by a yellow toner, resulting in an electrostatic latent image being formed on the surface of the image receptor 121 of the developing cartridge 120Y by an electric potential difference between the exposed area and the non-exposed area. The exposed area may have an electric potential of, e.g., approximately −50V while the non-exposed area may remain at the electric potential of 1200V, i.e., the surface electric potential that was previously charged by the charger 123.

As shown in FIG. 1, the yellow toner may be supplied from a toner storage tank 160, which, in this embodiment, is provided separately from the developing cartridges 120. It should however be understood that the toner may alternatively be stored and supplied from within the developing cartridges 120 itself instead of the toner storage tank 160.

More specifically, in the embodiment shown, the toner stored in the toner storage tank 160 is supplied to the developing cartridges 120 through a toner supplying pipe 128. The toner supplying pipe 128 extends in a lengthwise direction of the developing member 122, and includes a toner discharger 128*b* to supply the toner to the supplying roller 121*a*.

An auger 128*a* may be provided in the toner supplying pipe 128 to prevent the toner from being lumping in the supply pipe 128 and to supply the toner toward the supplying roller 121*a*. The toner supplying pipe 128 includes the toner discharger 128*b* to discharge the toner to the supplying roller 121*a*.

In this embodiment, the supplying roller 121*a* may friction-charge the toner to negative charge, and may supply the negatively charged toner to the developing member 122.

The developing member 122 may receive a voltage from the HVPS 190 to have the surface thereof charged to an electric potential of, e.g., about −600V. The yellow toner is supplied by the supplying roller 121*a* to the surface of the developing member 122.

The yellow toner may than be applied to the area of the image receptor 121 that had been exposed by the exposing unit in part by the electric potential existing between the developing member 122 and the image receptor 121. Thus, the electrostatic latent image is developed by the yellow toner into a visible yellow toner image on the image receptor 121.

The yellow visible image is then transferred from the surface of the image receptor 121 to the intermediate transfer belt 132 in cooperation with the intermediate transfer roller 131Y.

A magenta visible image is formed on the image receptor 121 of the magenta developing cartridge 120M according to the same process described above for forming the yellow visible image. The magenta visible image is transferred to the intermediate transfer belt 132 to overlap the yellow visible image that had been previously formed thereon.

The remaining visible images, i.e., cyan and black visible images are sequentially formed according to the foregoing process, and are transferred to the intermediate transfer belt 132, forming the complete color image on the intermediate transfer belt 132.

The resulting color image, e.g., including the YMCK toners, is transferred by the transfer unit 140 to a print medium P as the print medium passes between the intermediate transfer belt 132 and the transfer unit 140.

The color image so transferred is then fused on the print medium P by heat and/or pressure imparted by the fusing unit 160. The print medium P, on which the color image is fixed, is then discharged out of the image forming apparatus 100, completing the color image forming process.

The anti-spattering member 126 may collect toner particles floating in the image forming apparatus 100 to an outer surface thereof to prevent the toner from being spattered. The anti-spattering member 126 may include a conductive rotation shaft 126*a* (shown in, e.g., FIGS. 4 and 5) and a conductive elastic layer 126*b* formed to surround the rotation shaft 126*a*.

Figure 2:
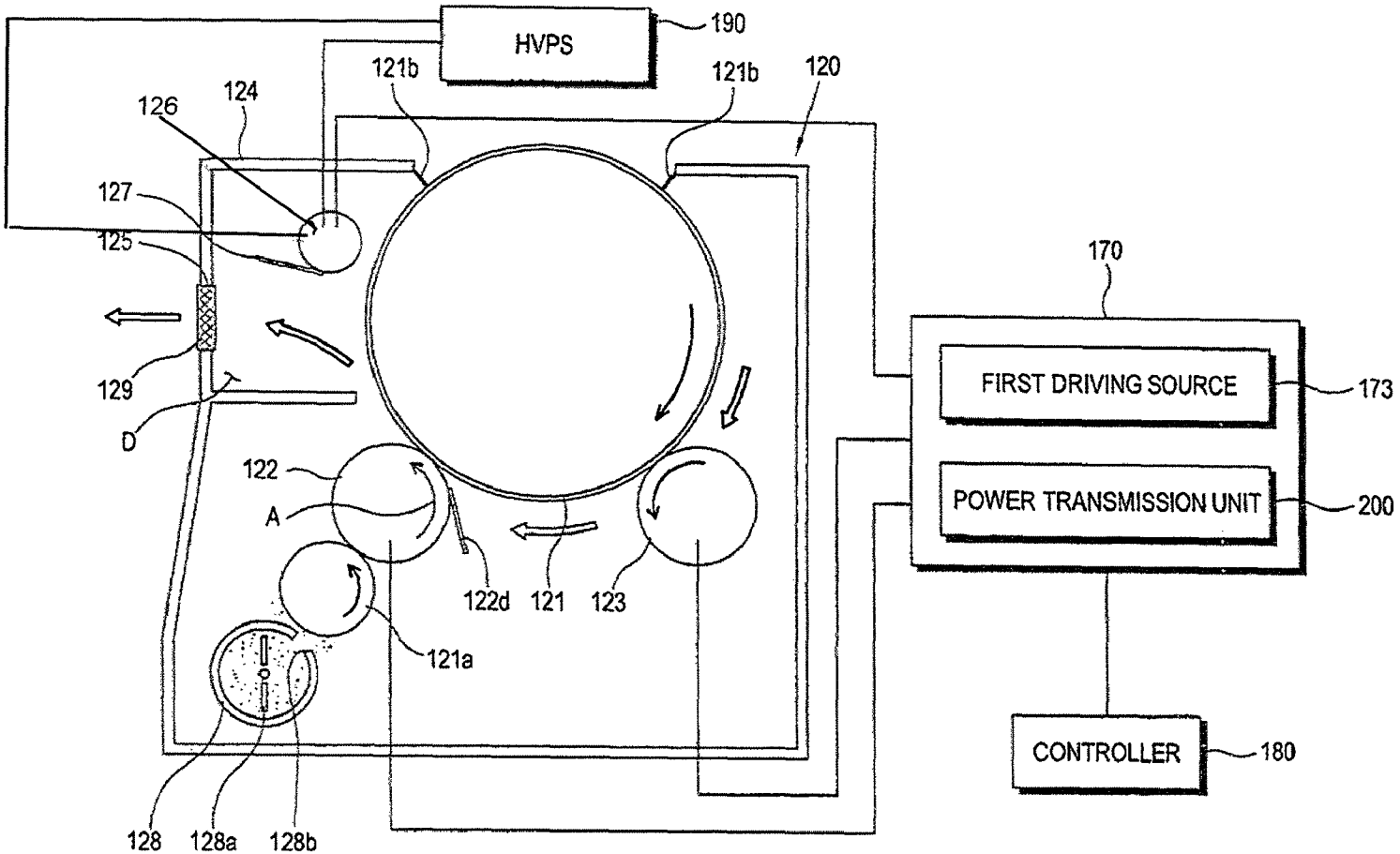
FIG. 2 is an enlarged sectional view illustrating relevant portions of the image forming apparatus in FIG. 1 during a printing operation.

As shown in FIG. 2, the image forming apparatus 100 according to the present embodiment may further include a driver 170 to drive the developing member 122 and the anti-spattering member 126 and a controller 180 to control the driver 170. The driver 170 may additionally drive other components, e.g., the charger 123.

The driver 170 may include a single driving source to drive both the developing member 122 and the anti-spattering member 126 or may include two or more driving sources to individually drive the developing member 122 and the anti-spattering member 126, respectively. A driving source may include, e.g., an electric motor.

When a single driving source is provided to drive both the developing member 122 and the anti-spattering member 126, the driver 170 may include a first driving source 173 to rotate the developing member 122 in a first direction and a second direction and a power transmission unit 200 to transmit power from the first driving source 173 to the anti-spattering member 126. The first driving source 173 may include, e.g., an electric motor. The power transmission unit 200 will be described in more detail later.

If two driving sources are provided to each individually drive one of the developing member 122 and the anti-spattering member 126, the driver 170 may include the first driving source 173 and an additional second driving source 200', in which case, the power transmission unit 200 may not be necessary The controller 180 controls the operation of the driver 170 to behave in the manner further described herein. To that end, the controller 180 may be a microprocessor, microcontroller or the like, that includes a CPU to execute one or more computer instructions to implement the controlling of the driver 170 as will be further described herein, and may further include a memory device, e.g., a Random Access Memory (RAM), Read-Only-Memory (ROM), a flesh memory, or the like, to store the one or more computer instructions. The controller 180 may further include one or more outputs for sending control signals to the driver 170.

According to an embodiment, the controller 180 may control the driver 170 so that driving power is not supplied to the anti-spattering member 126 when a printing operation is being performed, and to supply the driving power to the anti-spattering member 126 at other times.

For example, when the printing operation is currently being performed, it may mean that the image receptor 121 is rotating. A printing operation as referred to herein may include one or more of the aforementioned image forming processes, such as, for example, the picking up of the print medium P by the pickup roller 115, the formation of the electrostatic latent image, the development of the electrostatic latent image into a visible toner image, the transfer of the toner image onto the print medium, fusing of the transferred image on the print medium, and the discharging of the print medium P on which an image has been formed. It should be understood however that a printing operation is not limited to include any particular one or to performing any particular combination of the above processes. For example, and for the sake of brevity, for the foregoing description, and embodiment in which the printing operation is taken to be the process of developing the electrostatic latent image on the image receptor 121, that is, when the developing member 122 rotates in the direction for achieving the development of the electrostatic latent image, and in which the operation of the anti-spattering member 126 in order to reduce the adverse effect of noise and/or vibration from the anti-spattering member 126 on the developing process.

In the case where the driver 170 includes the first and second driving sources to drive the developing member 122 and the anti-spattering member 126, separately, the controller 180 may simply turn on the first driving source 173 to drive the developing member 122 while turning off the second driving source so as not to drive the anti-spattering member 126 during the printing operation. When the printing operation is not being performed, the controller 180 may turn off the first driving source 173 so as not to drive the developing member 122 and may turn on the second driving source to drive the anti-spattering member 126.

As the anti-spattering member 126 is made not to operate during a printing operation, vibration and noise of the anti-spattering member 126 possibly causing a jitter during the image forming process may be reduced.

During non-printing operation, for example, when a printing operation has just been completed, the anti-spattering member 126 is controlled to operate to prevent spattering of toner in the image forming apparatus 100.

The image forming apparatus 100 according to an embodiment may further include a cleaning member 127 to remove the toner from the outer surface of the anti-spattering member 126. The rotation of the anti-spattering member 126 and the arrangement of the cleaning member 127 may be made to encourages the contact between the surface of the anti-spattering member 126 and the cleaning member 127 in a manner that promotes the removal of toner from the anti-spattering member 126. According to an embodiment, the cleaning operation may be performed during non-printing operation period.

Figure 3:
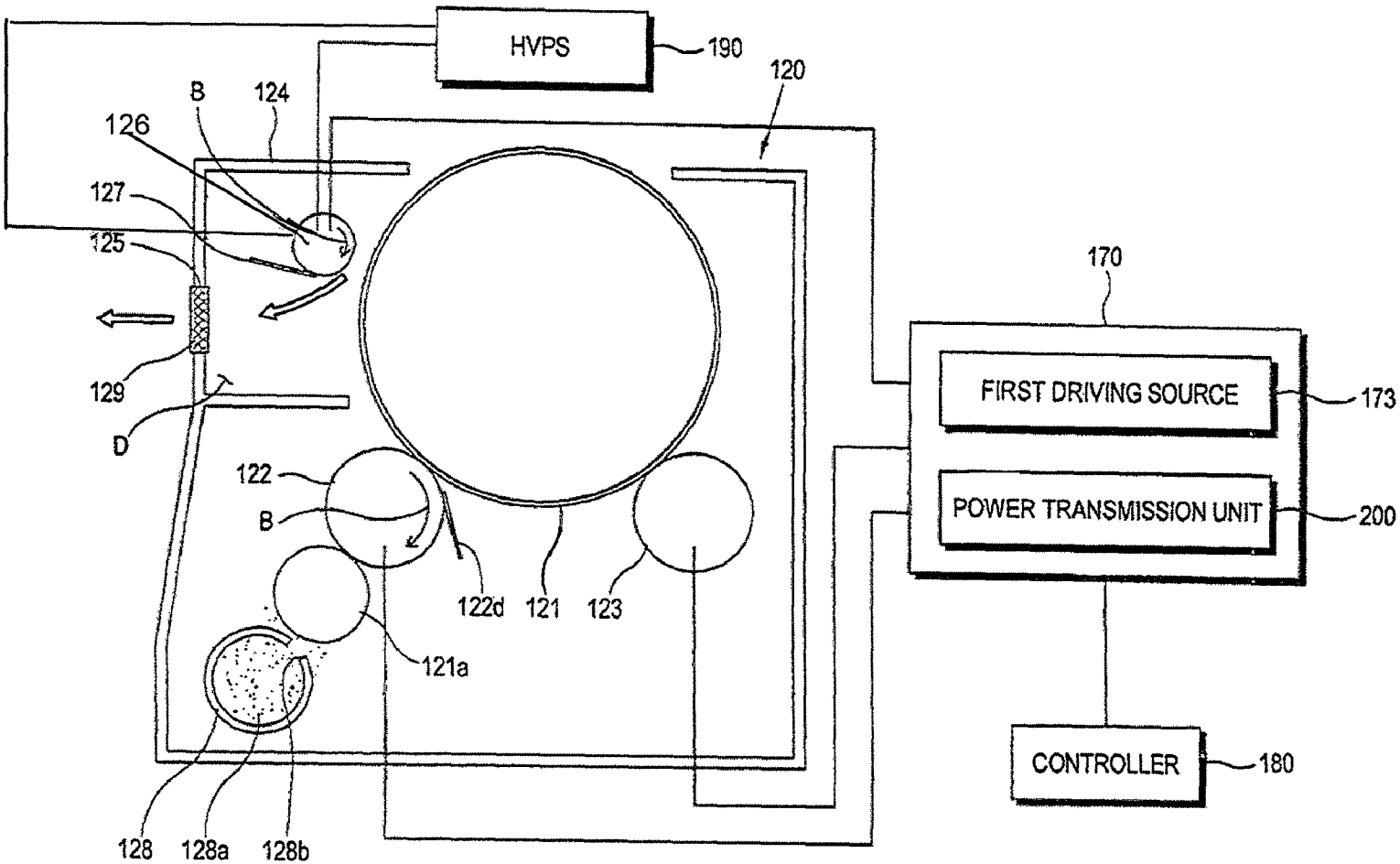
FIG. 3 illustrates the relevant portions shown in FIG. 1 during non-printing operation (e.g., during when the printing operation is finished)

FIGS. 2 and 3 illustrate the driving of the various components of a developing cartridges 120 during a printing operation period and during a non-printing operation period, respectively.

As shown in FIGS. 1 to 3, a developing cartridges 120 according to the embodiment may further include a casing 124 to accommodate therein the image receptor 121, the developing member 122 and the anti-spattering member 126. Alternatively, in another embodiment, the image receptor 121 may be provide outside the casing 124.

As shown in FIG. 2, the casing 124 has a collecting space D in which the spattered toner may be collected in part by an airflow created by the clockwise rotation of the image receptor 121. The directions of rotation of the various members described herein, for example the clockwise rotation of the image receptor 121, are provide for illustrative purpose only, and opposite directions can be selected in some implementations. In the embodiment shown, during a printing operation, the image receptor 121 rotates clockwise while the charger 123 and the developing member 122 rotate counterclockwise.

In the embodiment shown in FIG. 2, the anti-spattering member 126 is preferably provided in proximity of collecting space D so that the toner moving with the airflow may be attached to the surface of the anti-spattering member 126.

As shown in FIG. 2, an opening 125 may be provided in the casing 124 to allow between the collecting space D and the outside of casing 124 through the opening 125. The position, size and/or number of the opening 125 may be chosen appropriately depending on the particular configuration of the developing cartridge 120 to optimize the collection of scattering toner particles in the collecting space D.

The image forming apparatus 100 or the developing cartridges 120 according to an embodiment may further include a filter 129 which is provided in the opening 125 to prevent the collected toner from escaping out of the casing 124. The filter 129 may, for example, include minute air vents therein to filter toner particles while allowing air to flow therethrough. The filter 129 may include a minutely-porous material such as, e.g., a sponge.

According to an embodiment, an anti-leaking member **121*b* may be provided to prevent the toner from leaking through a gap between the casing 124 and the image receptor 121. The anti-leaking member 121*b* may include an elastic film material, and may be provided at location(s) of the casing 124** to close the gap.

As shown in FIG. 3, when the printing operation is not currently being performed, e.g., if the printing operation has just been finished, the image receptor 121 stops operating, and the anti-spattering member 126 is made to rotate clockwise by the driver 170. During this time, the charger 123 preferably also stops operating, too, to reduce power consumption. Thus, airflow is created from the anti-spattering member 126 towards the opening 125 as shown in FIG. 3.

If the driver 170 drives both the developing member 122 and the anti-spattering member 126 with a single first driving source 173, the developing member 122 may rotate clockwise and counterclockwise by the first driving source 173 as shown in FIGS. 2 and 3. As previously described, if two separate driving sources are used to drive the developing member 122 and the anti-spattering member 126, respectively, the first driving source 173 that drives the developing member 122 may be turned off while the anti-spattering member 126 is driven by the second driving source.

According to an embodiment, in the case where the first driving source 173 drives both of the developing member 122 and the anti-spattering member 126, the direction of the rotation of the first driving source 173 may be changed between printing operation period and non-printing operation as shown in FIGS. 2 and 3.

That is, during the printing operation, the controller 180 controls the first driving source 173 to rotate the developing member 122 in a first direction A (e.g., counterclockwise) as shown in FIG. 2. At other times, in case the operation of the anti-spattering member 126 is desired, the controller 180 controls the first driving source 173 to rotate the developing member 122 in a second direction B (clockwise) as shown in FIG. 3. The direction of the rotation of the developing member 122 may change by, e.g., switching the polarity of the power supplied to the first driving source 173.

According to the embodiment, the power transmission unit 200 prevents the driving power supplied by the first driving source 173 from being transmitted to the anti-spattering member 126 if the developing member 122 rotates in the first direction A (counterclockwise in FIG. 2), i.e., if the printing operation is being performed.

On the other hand, the power transmission unit 200 may allow the driving power supplied by the first driving source 173 to be transmitted to the anti-spattering member 126 if the developing member 122 rotates in the second direction B (clockwise). Thus, the anti-spattering member 126 rotates in the second direction B (clockwise), resulting in the airflow in the direction promoting the movement of the spattered toner to the collecting space D as shown in FIG. 3.

As described above, if the anti-spattering member 126 rotates, the cleaning member 127 cleans up the toner attached to the surface of the anti-spattering member 126. The toner which is detached from the surface of the anti-spattering member 126 by the cleaning operation gathers in the collecting space D by the air flow created by the rotation of the anti-spattering member 126.

Figure 4:
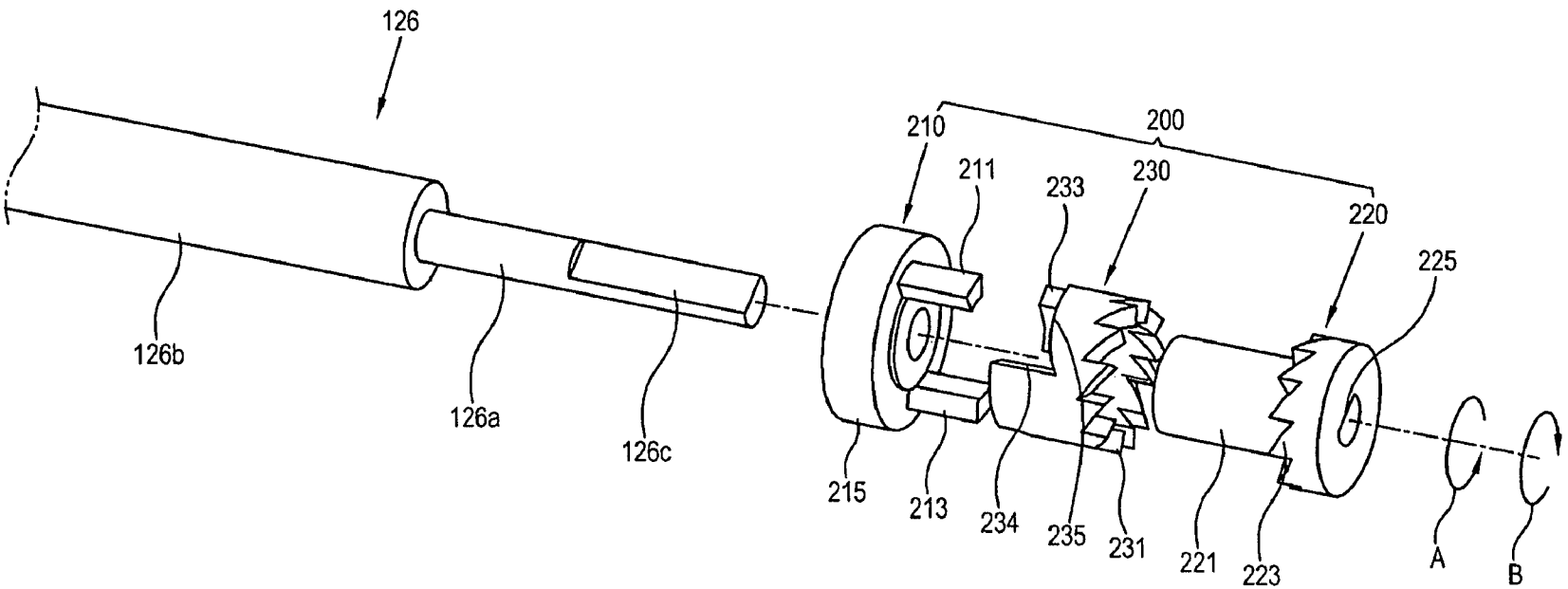
FIG. 4 is a perspective view illustrating an example of driving mechanism for the anti-spattering member according to an embodiment.
Figure 5:
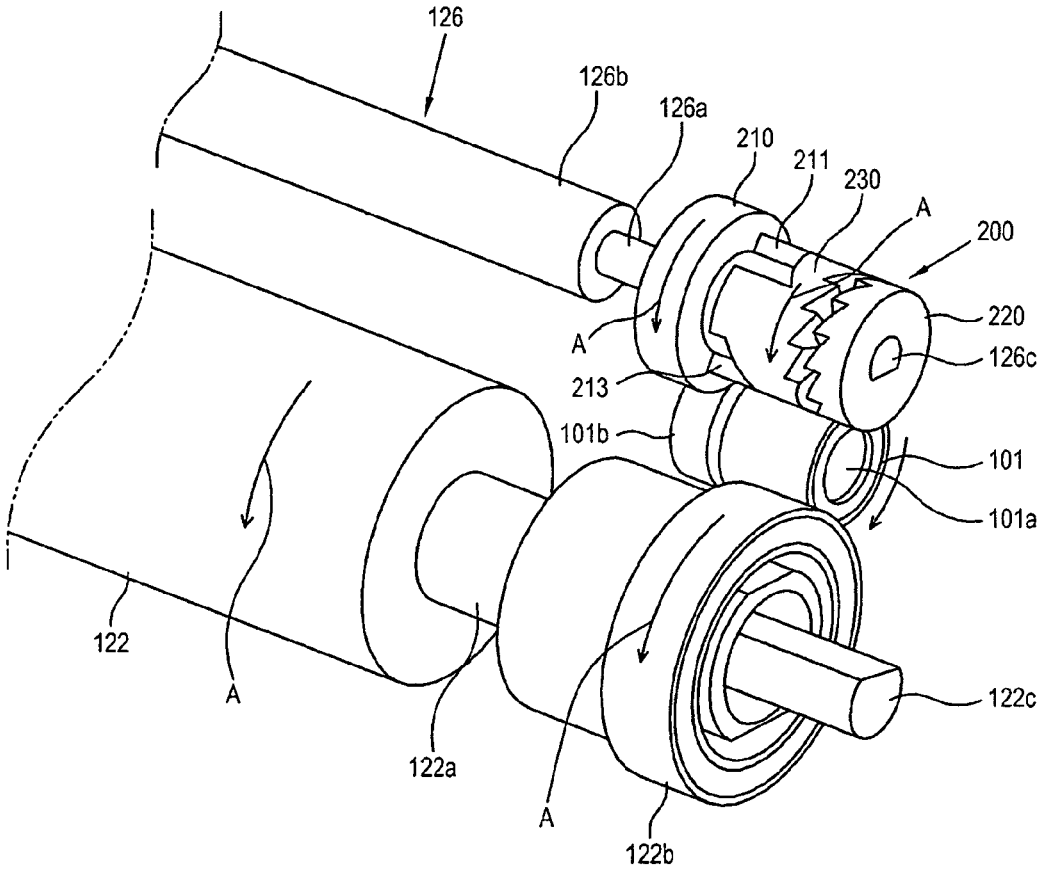
FIG. 5 is a perspective view illustrating the example driving mechanism for the anti-spattering member shown in FIG. 4 in relation to the developing member according to embodiment of an image forming apparatus during a printing operation.

An example mechanism for realizing the power transmission unit 200 is shown FIGS. 4 and 5. As shown, in this example, the power transmission unit 200 may be provided in the rotation shaft 126*a* of the anti-spattering member 126.

The power transmission unit 200 may include a driven rotation body 210 to receive power from the developing member 122, a first transmission member 220 provided in the rotation shaft 126*a* of the anti-spattering member 126 to rotate together with the anti-spattering member 126 and a second transmission member 230 interposed between the driven rotation body 210 and the first transmission member 220.

The driven rotation body 210 includes a driven gear 215 formed on an external circumference thereof and first and second driving pieces 211 and 213 protruding toward the second transmission member 230.

In the present embodiment, two driving pieces, namely, the first and second driving pieces 211 and 213 are provided to transmit power efficiently. As shown in FIG. 4, the first and second driving pieces 211 and 213 may be disposed to oppose each other. Alternatively, the driving pieces 211 and 213 may be replaced by three driving pieces at an interval of 120 degrees around the driven rotation body 210. As the process of transmitting power to the second driving member 230 by the first driving piece 211 is the same as that by the second driving piece 213, only the process of the transmitting the power by the first driving piece 211 will be described.

The driven rotation body 210 may be inserted into the rotation shaft 126*a* of the anti-spattering member 126. As the diameter of the opening of the driven rotation body 210 to receive the rotation shaft 126*a* is larger than the diameter of the rotation shaft 126*a* of the anti-spattering member 126, the driven rotation body 210 may rotate freely with respect to the rotation shaft 126.

A developing gear 122*b* which is provided in the rotation shaft 122*a* of the developing member 122 rotates by the driving power from the first driving source 173. The developing gear 122*b* is provided in a D-cut part 122*c* of the rotation shaft 122*a* to rotate together with the developing member 122.

As shown in FIG. 5, an idle gear 101 may be provided between the developing gear 122*b* and the driven rotation body 210. In an alternative embodiment, the idle gear 101 may be removed, allowing the developing gear 122*b* and the driven gear 215 to directly engage each other. A first part 101*a* of the idle gear 101 is coupled with the developing gear 122*b* while a second part 101*b* is coupled with the driven gear 215 of the driven rotation body 210. Thus, the driven rotation body 210 may rotate in the same direction as the developing member 122.

The first transmission member 220 includes an insertion hole 225 into which the D-cut part 126*c* of the rotation shaft 126*a* is inserted. The insertion hole 225 has a shape corresponding to the D-cut part 126*c*. The first transmission member 220 is thus coupled to, and rotates together with, the rotation shaft 126*a*, which is in turn coupled to rotate together with the anti-spattering member 126.

Figure 6A:
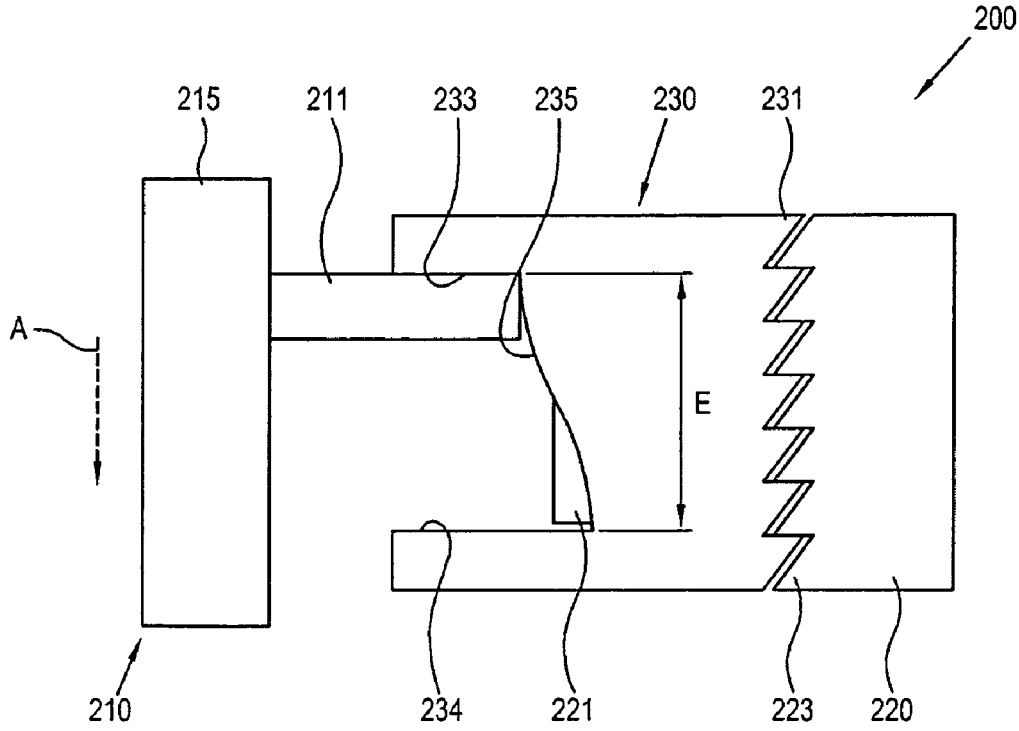
FIGS. 6A to 6C illustrate power transmission operations of the driving mechanism shown in FIG. 5 during a printing operation.

The first transmission member 220 may include first saw tooth 223 which faces a second saw tooth 231 of the second transmission member 230. The first and second saw teeth 223 and 231 may have shapes corresponding each other as shown in FIGS. 4 and 6A. That is, the first saw tooth 223 engages with the second saw tooth 231 to convey the driving power through the engagement when the developing member 122 rotates in the first direction A (counterclockwise in FIG. 2). Meanwhile, the first and second saw teeth 223 and 231 are disengaged with each other if the developing member 122 rotates in the second direction B (clockwise in FIG. 3).

The first transmission member 220 may include a cylindrical part 221, the length of which corresponds to the length of the D-cut part 126*c* of the rotation shaft 126*a* of the anti-spattering member 126, and an insertion hole 225. The cylindrical part 221 may pass through the second transmission member 230.

The second transmission member 230 may include a first cam 235, which contacts the first driving piece 211 of the driven rotation body 210, and which moves the second transmission member 230 forwards and backwards along the rotation shaft 126*a*. That is, the first cam 235 converts rotation of the first driving piece 211 into a linear movement of the second transmission member 230. The second transmission member 230 may further include a second cam (not shown), which contacts the second driving piece 213 of the driven rotation body 210, and which functions in similar manner as the first cam 235.

The second transmission member 230 may further include first power receivers 233 and 234, which contact the first driving piece 211 of the driven rotation body 210 to enable the second transmission member 230 to rotate together with the driven rotation body 210. According to an embodiment, the second transmission member 230 may further include a second power receiver (not shown), which contacts the second driving piece 213 of the driven rotation body 210, and which function similarly as the first power receivers 233 and 234. That is, the numbers of the first cam 235 and the power receivers 233 and 234 may correspond to the number of the driving pieces 211 and 213.

As shown in FIG. 6A, the first power receivers 233 and 234 are spaced from each other at a predetermined interval E. Thus, if the first driving piece 211 rotates in the first direction A, the first power receiver 234 contacts the first driving piece 211 to rotate the second transmission member 230 in the same direction as the first direction A. If the first driving piece 211 rotates in the second direction B, the first power receiver 233 contacts the first driving piece 211 to rotate the second transmission member 230 in the same direction as the second direction B.

Figure 6B:
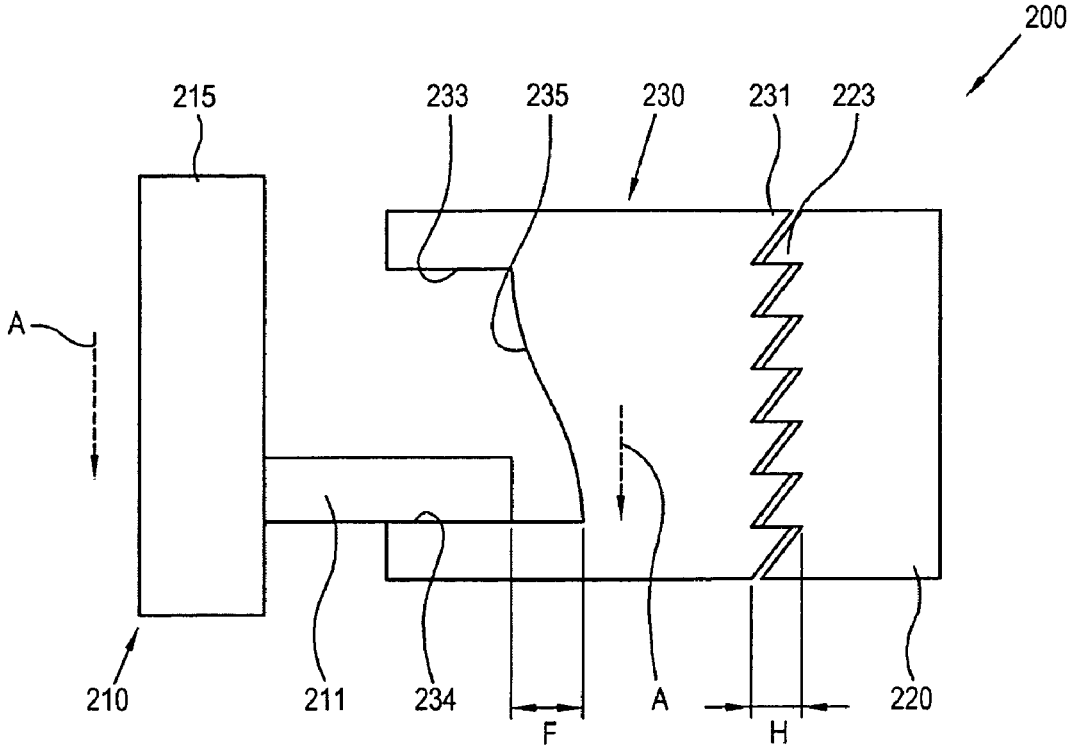
Figure 6C:
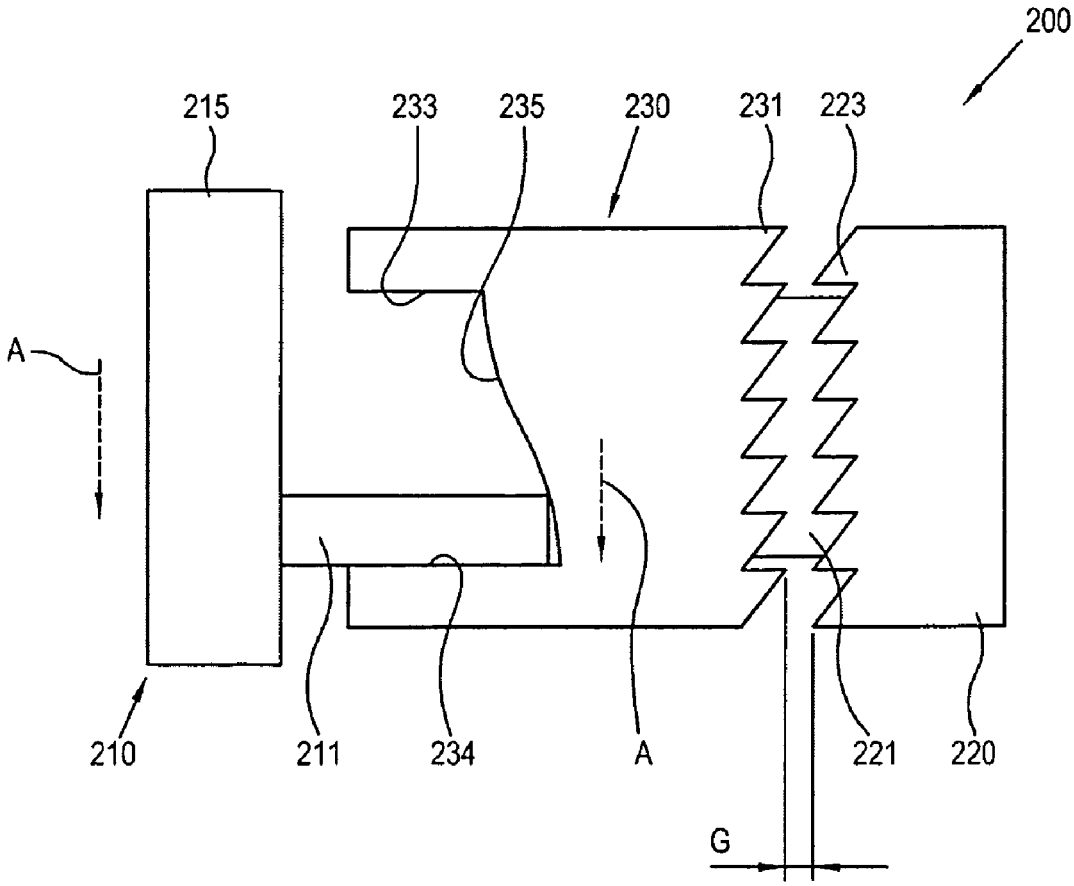

Referring to FIGS. 6A to 6C, the power transmission process of the power transmission unit 200 while the driven rotation body 210 rotates in the first direction A will be described.

As the developing member 122 rotates in the first direction A, the driven rotation body 210 of the power transmission unit 200 rotates in the same direction as that of the developing member 122.

As the driven rotation body 210 rotates in the first direction A, the first driving piece 211 contacts the first power receiver 234 as shown in FIG. 6B. The second transmission member 230 starts to rotate in the first direction A, and as a result of the rotation, moves away from the first transmission member 220 as shown in FIG. 6C. That is, the first saw tooth 223 becomes disengaged from the second saw tooth 231. As a result, the driving power transmission from the second transmission member 230 to the first transmission member 220 is cut off, and the anti-spattering member 126 (refer to FIG. 4) stops operating, i.e. is not driven.

Preferably, the gap F between the first driving piece 211 and the first cam 235 is larger than the gap H between the second saw tooth 231 and the first saw tooth 223 while the first driving piece 211 contacts the power receiver 234. As the gap G is formed between the first and second saw teeth 223 and 231 to provide a clearance therebetween, thus preventing noise and/or vibration that may result from the saw teeth 223 and 231 contacting each other.

Figure 7:
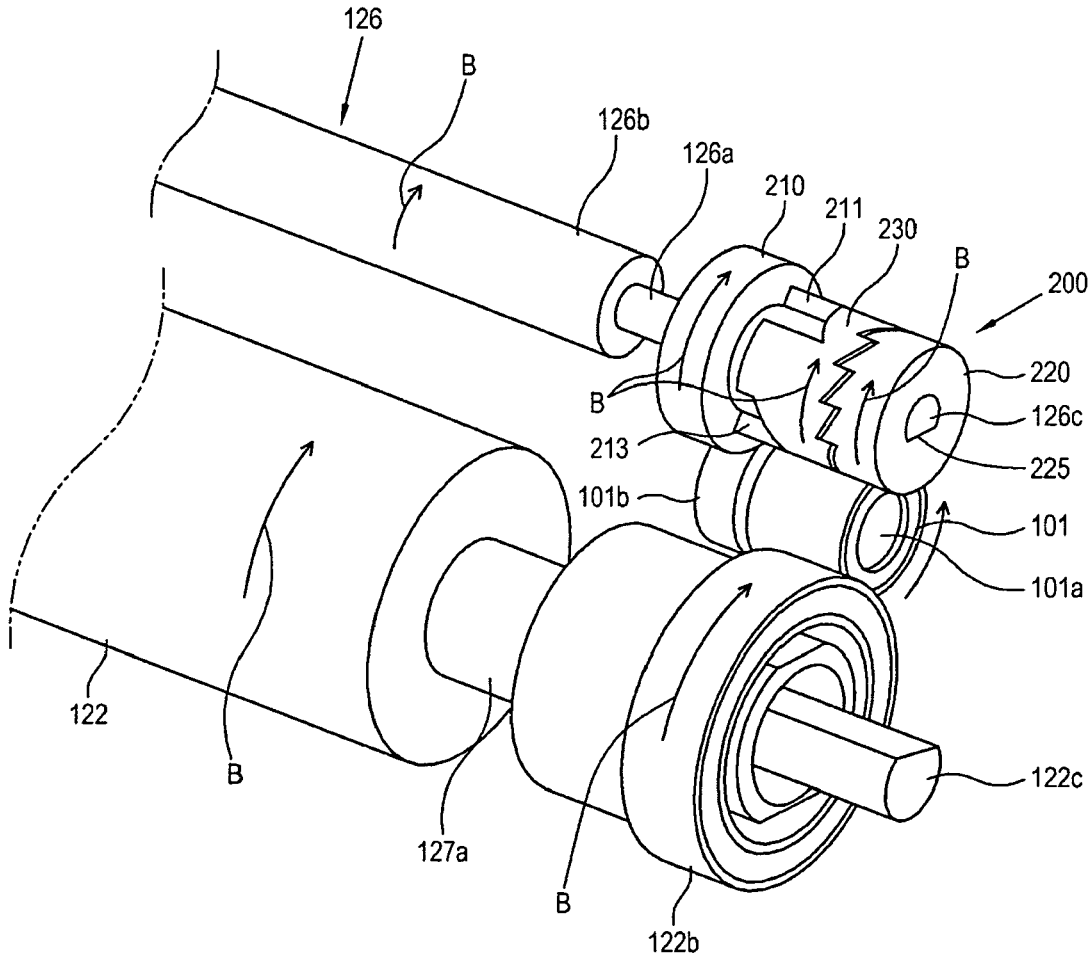
FIG. 7 is a perspective view illustrating the example driving mechanism for the anti-spattering member shown in FIG. 4 in relation to the developing member according to embodiment of an image forming apparatus during a non-printing operation.

As shown in FIG. 7, if the developing member 122 rotates in the second direction B, the driven rotation body 210 of the power transmission unit 200 also rotates in the second direction B.

Figure 8A:
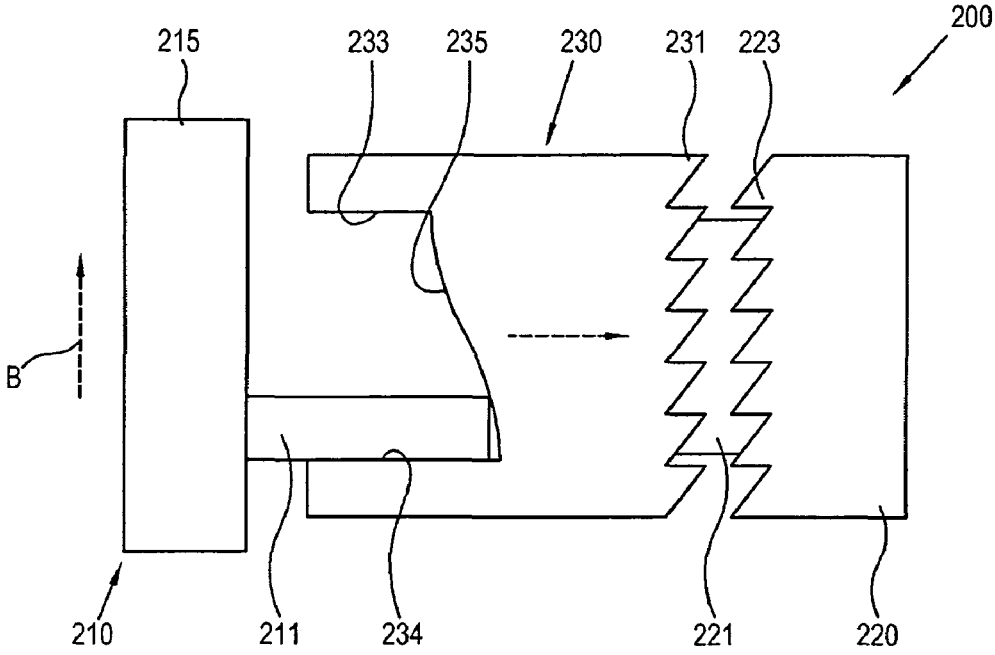
FIGS. 8A and 8B illustrate power transmission operations of the driving mechanism shown in FIG. 7 during a non-printing operation.
Figure 8B:
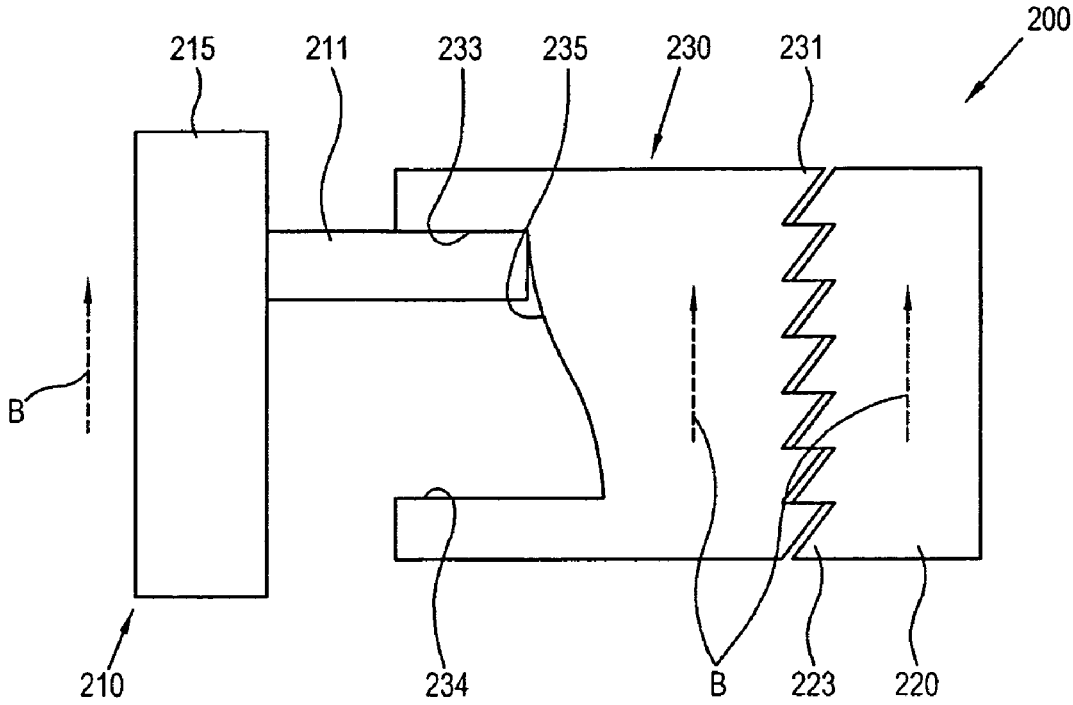
Figure 9:
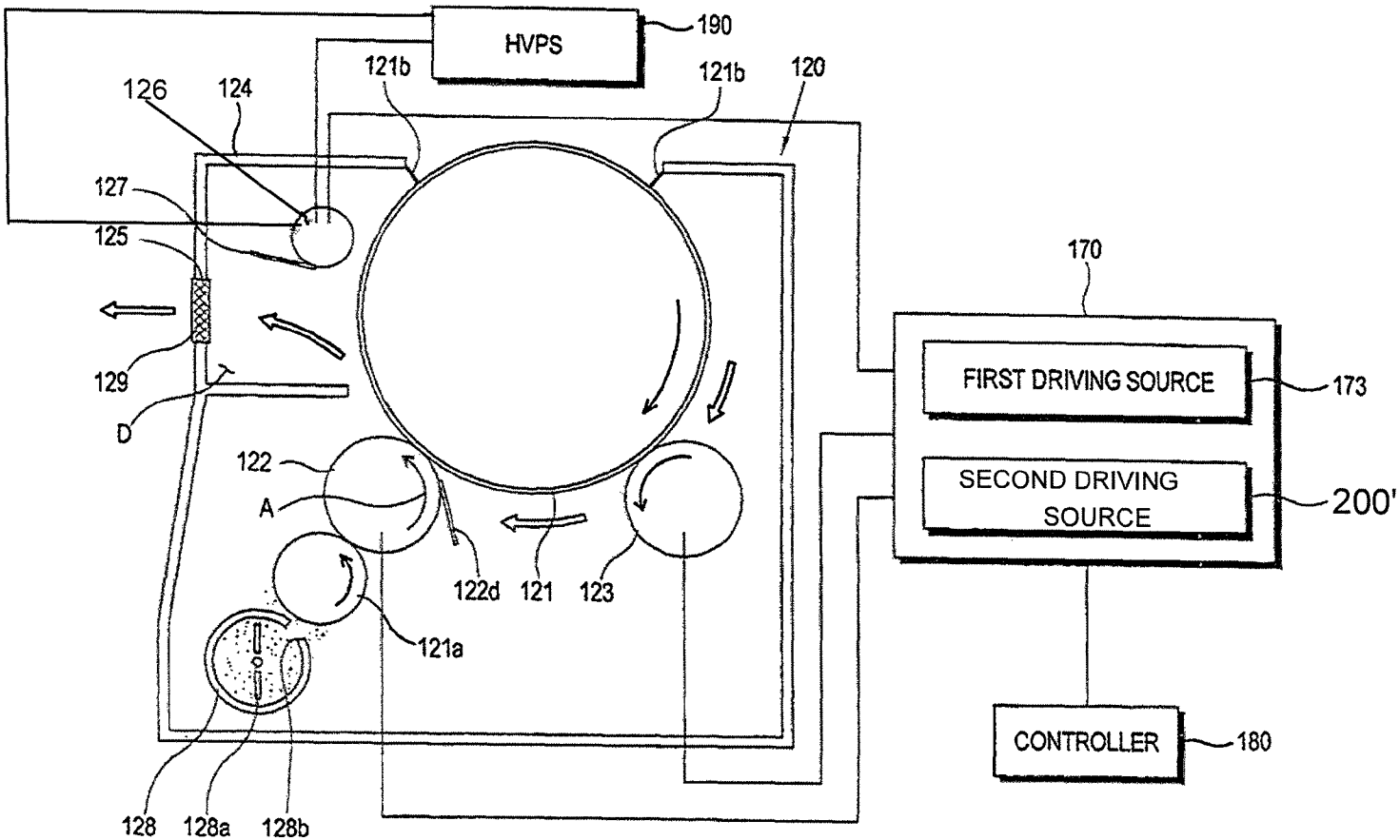
FIG. 9 is an enlarged sectional view illustrating an alternative embodiment of the image forming apparatus shown in FIG. 2.

A process of transmitting power while the driven rotation body 210 rotates clockwise (in the second direction B) according to an embodiment will be described with reference to FIGS. 8A and 8B.

If the driven rotation body 210 rotates in the second direction B, the first driving piece 211 contacts the first cam 235 to move the second transmission member 230 towards the first transmission member 220. As shown in FIG. 8B, the second saw tooth 231 of the second transmission member 230 becomes engaged with the first saw tooth 223 of the first transmission member 220 to transmit rotational force to the first transmission member 220.

As the first transmission member 220 rotates clockwise in the second direction B, the anti-spattering member 126 also rotates in the second direction B (clockwise in FIG. 3) as shown in FIG. 7. Then, an airflow may be formed from the anti-spattering member 126 to the filter 129 as shown in FIG. 3.

As shown in FIGS. 1 to 3, the image forming apparatus 100 and the developing cartridges 120 may further include a doctor blade 122*d* to control a thickness of a toner layer applied to the surface of the developing member 122. The doctor blade 122*d* is optimized to control the toner layer in a proper thickness if the developing member 122 rotates in the first direction A.

An excessive rotation of the developing member 122 in the second direction B, the toner layer on the surface of the developing member 122 may become regulated excessively by the doctor blade 122*d* to result in non-uniform thickness. Thus, according to an embodiment of the present invention, the rotation of the developing member 122 in the second direction B may be limited, e.g., to about a quarter turn (90 degrees). That is, during non-printing operation period, the controller 180 controls the driver 170 to rotate the developing member 122 only a quarter turn.

In this embodiment, a gear ratios between the developing gear 122*b*, the idle gear 101 and the driven rotation body 210 are preferably set to rotate the anti-spattering member 126 four or five turns when the developing member 122 rotates a quarter turn (90 degrees).

While in the above embodiment, the developing member 122 rotates a quarter turn in the second direction B to drive the anti-spattering member 126, it should be understood that any rotational angle, including, e.g., 360 degrees, 720 degrees, or more, of the developing member 122 may be possible. Indeed, the developing member 122 may rotate in the second direction B plural turns to enhance the effect of the anti-spattering member 126.

While in the embodiments described above, the driving power is transmitted from the developing gear 122*b* to the driven rotation body 210 by engagement of gears, it should be understood that the driving power may alternatively be transmitted by other known power transmission means such as chains and belts.

Further, while the anti-spattering member 126 of the embodiments described thus far operates or stops operating according to the direction of the rotation of the developing member 122, the scope of the present invention is not so limited. It should be readily apparent to one of ordinary skill that the operation of the anti-spattering member 126 can be made to relate to other components, including, e.g., the charger 123 or the image receptor 121.

The anti-spattering member 126 may be applied a predetermined voltage so that the spattered toner more readily attach to the surface thereof. Preferably, the predetermined voltage includes a positive DC voltage so that the toner is attached to the surface of the anti-spattering member 126 by electrical attraction if the toner is friction-charged to a negative electric charge. If, on the other hand, the spattered toner is positively charged, the predetermined voltage may include a negative DC voltage. The predetermined voltage may be generated by the HVPS 190 or by an additional voltage power supply. In one embodiment, the predetermined voltage may also be a ground voltage. That is, the anti-spattering member 126 may be connected to a ground terminal.

Hereinafter, a control method of the image forming apparatus 100 capable of being implemented by the controller 180 according to an embodiment will be briefly described.

When the printing operation is being performed by the image receptor 121 and/or the developing member 122, the anti-spattering member 126 stops operating, i.e. the anti-spattering member 126 is not driven (S10). In an embodiment, the controller 180 controls the driver 170 to cause the developing member 122 to rotate in the first direction A. The transmission unit 200 prevents the driving power from the driver 170 from being delivered to the anti-spattering member 126.

At other times, for example, when printing operation is stopped or has just been completed, the anti-spattering member 126 operates (S20). In an embodiment, the controller 180 controls the driver 170, for example, by producing and communicating control signals(s) to the driver 170, to cause the development member 122 to rotate in the second direction B. The transmission unit 200 allows the driving power from the driver 170 to be delivered to the anti-spattering member 126.

The control method of the image forming apparatus 100 according to an embodiment may further include an operation of applying a voltage to the anti-spattering member 126 (S30). The operation S30 may be performed in either the operation S10 or the operation S20. If the toner is friction-charged to have a negative electric charge, the voltage may include a predetermined (+) DC voltage. The voltage may alternatively include a ground voltage. If on the other hand, the toner exhibits a positive charge, the anti-spattering member 126 may be applied a negative voltage.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. An image forming apparatus, comprising:

a rotational member configured to rotate during a printing operation of the image forming apparatus;

an anti-spattering member spaced a distance away from the rotational member and having a surface capable of having toner particles adhered thereto;

a driver configured to drive at least one of the rotational member and the anti-spattering member; and a controller configured to control the driver such that the driver does not drive the anti-spattering member during the printing operation and such that the driver drives the anti-spattering member at other times during which the printing operation is not being performed.

2. The image forming apparatus according to claim 1, further comprising:

a high voltage power supply (HVPS) configured to apply a first voltage to a developing member, and to apply a second voltage to the anti-spattering member so that the toner particles are attached to the anti-spattering member by an electric force.

3. The image forming apparatus according to claim 1, further comprising:

a cleaning member disposed at the anti-spattering member, the cleaning member being configured to remove the toner particles that are attached to the anti-spattering member.

4. The image forming apparatus according to claim 1, wherein:

the driver comprises a first driving source and a second driving source, the first driving source being configured to drive a developing member included with the rotational member, and the second driving source being configured to drive the anti-spattering member, and wherein the controller is configured to control the first and second driving sources such that, during the printing operation the first driving source operates while the second driving source does not operate, and, such that, when the printing operation is not being performed, the first driving source does not operate while the second driving source operates.

5. The image forming apparatus according to claim 1, wherein the driver comprises a first driving source and a power transmission unit, the first driving source being configured to drive both the rotational member and the anti-spattering member, the first driving source being configured to rotate the rotational member in a first direction and a second direction, the power transmission unit being configured to selectively transmits a driving power from the rotational member to the anti-spattering member based on whether the rotational member rotates in the first direction or in the second direction.

6. The image forming apparatus according to claim 5, further comprising:

an image receptor having a surface on which an electrostatic latent image is to be formed, and wherein the rotational member comprises a developing member configured to develops the electrostatic latent image of the image receptor into a toner image.

7. The image fanning apparatus according to claim 6, wherein the printing operation comprises an operation of developing the electrostatic latent image into the toner image, and wherein the controller controls the driver to rotate the developing member in the first direction during the printing operation, the controller controlling the driver to rotate the developing member in the second direction, and to drive the anti-spattering member, when the printing operation is not being performed.

8. The image fanning apparatus according to claim 7, wherein the power transmission unit comprises:

a driven rotation body configured to receive a rotational force from the developing member;

a first transmission member coupled to a rotation shaft of the anti-spattering member to rotate together with the anti-spattering member; and a second transmission member disposed between the driven rotation body and the first transmission member, the second transmission member being configured to receive the rotational force from the driven rotation body, and to move between an engaged position and a disengaged position, the second transmission member being engaged with the first transmission member when the second transmission member is in the engaged position to convey the rotational force to the first transmission member, the second transmission member being disengaged with the first transmission member when the second transmission member is in the disengaged position such that the rotational force from the second transmission member is not conveyed to the first transmission member, the second transmission member being configured to move to the engaged position when the driven rotation body rotates in the second direction, and the second transmission member being configured to move to the disengaged position when driven rotation body rotates in the first direction.

9. The image forming apparatus according to claim 8, wherein the first transmission member and the second transmission members are spaced apart by a sufficient distance from each other so as not to interfere with each other when the second transmission member is in the disengaged position.

10. The image forming apparatus according to claim 8, wherein:

the driven rotation body comprises a driving piece extending from the driven rotation body toward the second transmission member, and wherein the second transmission member comprises a cam configured to contact the driving piece, and to cause the second transmission member to move toward the first transmission member when the driving piece rotates in the second direction.

11. The image forming apparatus according to claim 10, wherein the second transmission member further comprises a power receiver configured to contact the driving piece to receive the rotational force.

12. The image forming apparatus according to claim 6, further comprising:

a casing which accommodates therein the image receptor, the developing member and the anti-spattering member, the casing further including a collecting space to which the toner particles are directed by an airflow created by the rotation of at least one of the developing member, the image receptor and the anti-spattering member.

13. The image forming apparatus according to claim 12, wherein the anti-spattering member is provided in proximity of the collecting space.

14. The image forming apparatus according to claim 13, wherein the casing comprises an opening through which air can flow from the collecting space to the outside of the casing, the image forming apparatus further comprising:

a filter which is provided in the opening, the filter being configured to block the toner particles from being discharged out of the casing through the opening.

15. The image forming apparatus according to claim 6, wherein:

the controller is configured to control the driver to limit the rotation of the development member in the second direction to a predetermined amount.

16. The image forming apparatus according to claim 15, wherein:

the controller is configured to control the driver to limit the rotation of the development member in the second direction to about 90 degree turn.

17. A control method of an image forming apparatus having an image receptor, a developing member to develop a latent image on the image receptor with a toner and an anti-spattering member spaced a distance away from the developing member to collect free toner particles, the control method comprising:

performing a print operation that drives the developing member; and controlling a driving of the anti-spattering member without contacting the developing member such that the anti-spattering member is not driven during the printing operation, and such that the anti-spattering member is driven when the print operation is not being performed.

18. The control method according to claim 17, wherein said step of performing the printing operation comprises driving at least one of the image receptor and the developing member to rotate in a first direction, the method further comprising:

driving the at least one of the image receptor and the developing member to rotate in a second direction during when the print operation is not being performed, and wherein the step of controlling the driving of the anti-spattering member comprises:

preventing the anti-spattering member from being driven when the at least one of the image receptor and the developing member rotates in the first direction; and allowing the anti-spattering member to be driven by the at least one of the image receptor and the developing member to rotate in the second direction when the at least one of the image receptor and the developing member rotates in the second direction.

19. The control method according to claim 18, wherein:

the step of driving the at least one of the image receptor and the developing member to rotate in the second direction comprises driving the at least one of the image receptor and the developing member such that the at least one of the image receptor and the developing member rotates in the second direction by only a limited predetermined rotational angle.

20. The control method according to claim 17, further comprising: applying a voltage to the anti-spattering member.

21. An image forming apparatus, comprising:

a rotational member configured to rotate during a printing operation of the image forming apparatus;

an anti-spattering member having a surface capable of having toner particles adhered thereto;

a driver configured to drive at least one of the rotational member and the anti-spattering member; and a controller configured to control the driver such that the driver does not drive the anti-spattering member during the printing operation and such that the driver drives the anti-spattering member at other times during which the printing operation is not being performed, wherein the anti-spattering member is applied with a predetermined voltage, so that the toner particles are attached to the surface thereof by an electric force.

* * * * *